US008919992B2

(12) United States Patent
Dellian et al.

(10) Patent No.: US 8,919,992 B2
(45) Date of Patent: Dec. 30, 2014

(54) LED LIGHTING DEVICE AND METHOD FOR MANUFACTURING AN LED LIGHTING DEVICE

(75) Inventors: Harald Dellian, Edling (DE); Thomas Preuschl, Sinzing (DE)

(73) Assignee: Osram AG, Munich (DE)

( * ) Notice: Subject to any disclaimer, the term of this patent is extended or adjusted under 35 U.S.C. 154(b) by 50 days.

(21) Appl. No.: 13/703,903

(22) PCT Filed: Jun. 22, 2011

(86) PCT No.: PCT/EP2011/060414
§ 371 (c)(1),
(2), (4) Date: Dec. 13, 2012

(87) PCT Pub. No.: WO2012/000860
PCT Pub. Date: Jan. 5, 2012

(65) Prior Publication Data

US 2013/0094200 A1 Apr. 18, 2013

(30) Foreign Application Priority Data

Jul. 2, 2010 (DE) ..... 10 2010 030 863

(51) Int. Cl.

| | |
|---|---|
| ***F21V 3/00*** | (2006.01) |
| ***F21V 3/04*** | (2006.01) |
| ***F21V 29/00*** | (2006.01) |
| ***F21V 3/02*** | (2006.01) |
| ***F21K 99/00*** | (2010.01) |
| *F21Y 103/00* | (2006.01) |
| *F21V 17/10* | (2006.01) |
| *F21V 31/00* | (2006.01) |
| *F21Y 101/02* | (2006.01) |

(52) U.S. Cl.

CPC ..... *F21V 3/00* (2013.01); *F21V 3/0472* (2013.01); *F21V 29/22* (2013.01); *F21V 29/2206* (2013.01); *F21V 3/02* (2013.01); *F21K 9/17* (2013.01); *F21Y 2103/003* (2013.01); *F21V 17/101* (2013.01); *F21V 31/005* (2013.01); *F21Y 2101/02* (2013.01); *F21V 29/004* (2013.01)

USPC ..... 362/225; 362/246; 362/254; 362/218; 362/217.02

(58) Field of Classification Search

USPC ..... 362/249.02, 311.02, 244, 246, 254, 362/225, 218, 217.02, 219

See application file for complete search history.

(56) References Cited

U.S. PATENT DOCUMENTS

| | | | |
|---|---|---|---|
| 5,593,722 | A | 1/1997 | Otani et al. |
| 8,167,454 | B2 | 5/2012 | Maier |

(Continued)

FOREIGN PATENT DOCUMENTS

| | | | |
|---|---|---|---|
| DE | 102008016457 | A1 | 10/2009 |
| DE | 102008025398 | A1 | 12/2009 |
| GB | 2366610 | A | 3/2002 |
| WO | 2009119038 | A2 | 10/2009 |
| WO | 2009121554 | A1 | 10/2009 |

OTHER PUBLICATIONS

Office Action issued in the corresponding Chinese application No. 201180033326.9, dated Jun. 16, 2014 (with translation).

*Primary Examiner* — Laura Tso

(57) ABSTRACT

An LED lighting device may include an LED support, which is populated with at least one LED on a front side thereof and a rear side of which is fastened to a rest. The front side of the LED support may be overarched by an electrically insulating, light-permeable and diffusely scattering LED cover, and the LED cover may be overarched by a protection cover resting on the support.

20 Claims, 2 Drawing Sheets

(56) References Cited

U.S. PATENT DOCUMENTS

| | | | | |
|---|---|---|---|---|
| 8,425,081 | B2 * | 4/2013 | Osawa | 362/249.02 |
| 8,506,103 | B2 * | 8/2013 | Iimura et al. | 362/84 |
| 2003/0193055 | A1 | 10/2003 | Martter et al. | |
| 2006/0146531 | A1 * | 7/2006 | Reo et al. | 362/244 |
| 2009/0219713 | A1 * | 9/2009 | Siemiet et al. | 362/218 |
| 2009/0290334 | A1 * | 11/2009 | Ivey et al. | 362/219 |
| 2010/0033964 | A1 | 2/2010 | Choi et al. | |
| 2010/0110678 | A1 | 5/2010 | Shen et al. | |

* cited by examiner

LED LIGHTING DEVICE AND METHOD FOR MANUFACTURING AN LED LIGHTING DEVICE

RELATED APPLICATIONS

The present application is a national stage entry according to 35 U.S.C. §371 of PCT application No. PCT/EP2011/060414 filed on Jun. 22, 2011, which claims priority from German application No. 10 2010 030 863.3 filed on Jul. 2, 2010.

TECHNICAL FIELD

Various embodiments relate to an LED lighting device, in particular an LED tubular lamp. Furthermore, various embodiments relate to a method for manufacturing an LED lighting device.

BACKGROUND

In LED tubular lamps (lamps with a tubular outer contour which typically have several light emitting diodes (LEDs) as their light sources) space is very limited. As a result of the necessary electronics (drivers) for controlling the LEDs, in addition the lateral distance between a rest for applying an LED support populated with the LEDs and the LEDs is critical. In addition, other optics for light distribution, in particular light dispersion, are required in order to avoid inhomogeneous light distribution, which is caused by using the LEDs as point light sources.

SUMMARY

Various embodiments provide an LED lighting device which at least alleviates at least one of the disadvantages of the prior art and in particular provide an LED lighting device, in particular an LED tubular lamp, with a more cost-effective construction.

Various embodiments provide an LED lighting device, having an LED support which is populated with at least one LED on the front side thereof and the rear side of which is fastened to a rest, the front side of the LED support being overarched by an electrically insulating, light-permeable and diffusely scattering cover (the "LED cover") and said LED cover being over arched by a protection cover resting on the support. The LED cover thus serves both as an electrical insulation or cover (additional cover) as well as an optical element for light distribution. As a result, components can be cut down on, which firstly reduces the expenditure on manufacture and assembly. In addition, space is created on the rest which can, for example, be used to accommodate electronic components. As a result of the dual electrical cover (the at least partially light-permeable protection cover can also serve as a basic electrical cover and consist of an electrically insulating material), such an LED lighting device meets diverse electrical standards, in particular for operating the LEDs in a non-SELV configuration (a configuration in which at least the LEDs are operated at a voltage which is higher than a safety extra-low voltage).

The protection cover can scatter in a transparent or diffuse manner. The design as a diffuser reinforces the homogenization of the incident light.

It is an embodiment that the LED cover is formed from a body which also forms an intermediate layer between the rear side of the LED support and the rest (which can also be designed as a heat sink). In other words, the LED cover can also be used as or form an intermediate layer between the rear side of the LED support and the rest. As the material of the LED cover is electrically insulating, it achieves additional electrical insulation of the LED support in respect of the rest as an intermediate layer. As a result of the integral embodiment, additional components can be cut down on and even simpler assembly is possible.

The LED cover is preferably a good conductor of heat throughout its thickness in order to keep thermal contact resistance low and heat loss from the LEDs in respect of the heat sink high. This can be achieved by the material being a good conductor of heat in bulk form and/or having a corresponding thickness (being thin).

In particular, the LED cover (or the body which forms the LED cover with the intermediate layer) can be present in the shape of a rolled-up, flexible sheet. A sheet can in particular mean a body, the expansion of which on a plane is far greater than its thickness. A particularly thin sheet can also be described as a film. The rolled-up sheet may in particular have a hollow cylindrical basic shape, and namely for example, a circular cross-section profile, an oval cross-section profile, a square cross-section profile, a free-form cross-section profile, etc.

The rolled-up sheet abuts a (flat or linear) joint area and forms a closed body running around the longitudinal axis along its longitudinal axis around which the sheet is rolled. As a result at least in the longitudinal direction of the rolled-up sheet at least one section of the LED support can be surrounded circumferentially by the electrically insulating, flexible body. This increases the electrical protection. The rolled-up form, which e.g. can be achieved by appropriate bending of the sheet, simplifies assembly.

The rolled-up LED cover and the joint area can press against one another without being firmly connected to one another. It is advantageous for the prevention of an unintended release of the joint area that the rolled-up LED cover is firmly connected at its joint area.

It is an advantageous development for the prevention of an unintended release of the sheet-shaped LED cover at its joint area that the lateral edges are joined by material engagement, in particular welded together (in particular laser-welded) or glued. In particular welding has the advantage of thermoforming the material of the LED cover in the joint area, which achieves a firm connection in standard technology. As a result a sealed unit is formed, which reduces a number of possible clearance and creepage distances.

Another embodiment is that the rest has at least one mounting recess to receive a part of the LED cover. The mounting recess can e.g. have at least one groove in the rest, into which the material of the LED cover can be inserted and/or clamped.

For example, the LED cover may be in the shape of a rolled-up sheet, which on its outside projects at least partially above its joint area and is press-fitted into a longitudinal groove in the rest with at least a part of the free edge of the projecting area. The LED cover can therefore be inserted into the rest in particular by means of only one edge or at least one latching projection. The free edge can be shaped in a straight or structured manner to fit this, e.g. be provided with defined projections. A further mechanical fixation is achieved by the downforce of the LED support, this in turn e.g. by hold-down clamps, plastic rivets, mechanical mounts, etc.

In another development the LED cover can in particular have a non-closed contour or shape and e.g. together with the rest form a cavity (if necessary, open at the ends) for the populated LED support. The LED cover can then in particular be fastened with at least one part of its free edges on the rest.

The LED cover can, for example, be put over the LED support. The LED cover can be inserted e.g. with free edges facing each other into two parallel grooves of the rest. The LED cover may in particular have an at least approximately half hollow cylindrical cross-sectional shape. By means of the width of the LED cover, its curvature is also ascertained. The LED cover may in particular be flexible or substantially rigid (only slightly flexible and/or self-supporting) in this development. In particular in the substantially rigid embodiment, a rotationally symmetrical shape is also possible, e.g. a semi-spherical LED cover.

The LED cover may generally consist of plastic.

The LED cover can furthermore be provided with opaque aperture areas in order to systematically form a shape of emitted light beams. In particular an exit angle of the light (aperture) can be influenced. This can be advantageous e.g. for specialist lamps for reading, playing music, etc. The aperture areas can, for example, be formed by a metallization or another reflecting layer of the LED cover.

Another embodiment is that at least on one front side of the LED support existing conductor tracks are directly (that is to say, without a space or cavity) covered by means of a conductor track cover. As a result of this, the creepage distances can be extended to increase the electrical protection.

A development is that the conductor track cover consists of glass or a vitreous material. The glass (or vitreous material) can be applied e.g. by means of a (glass) printing method and e.g. subsequently burned into the LED support.

For the burn-in, which is preferably performed in a temperature range of approx. 600° C. to 850° C., a high temperature-resistant base material of the LED support is preferred, in particular ceramic, e.g. aluminum oxide or aluminum nitride.

Another embodiment is that the conductor track cover substantially covers the entire front side of the LED support outside the LED. This extends creepage distances particularly reliably.

Another embodiment is also that between the rear side of the LED support and the rest there is a thermally conductive heat conducting material, in particular TIM ("thermal interface material"; e.g. a heat conducting paste or heat conducting adhesive), in particular a heat conducting adhesive. As a result, heat dissipation from the LEDs to the support can be particularly effectively arranged. It is a development that the LED support is directly connected to the support via the heat conducting material.

The LED cover can, for example, be inserted into a gap in the rest in which the LED support is also contained. In particular, if the gap has a steplike limitation, the cover can use the limitation as a stop for its precise positioning. Alternatively, the rest may have a dedicated mounting recess, e.g. longitudinal grooves for insertion of the LED cover. The LED cover may be clamped or glued in it, e.g. by means of adhesive dispensing.

An advantageous embodiment for an effective electrical insulation of the LEDs and the conductor tracks is that the LED support has a base body of electrically insulating ceramic (e.g. aluminum oxide, aluminum nitride, etc.).

Ceramics generally exhibit high dielectric strength. In particular, the use of an LED support with a ceramic base body enables the operation of the light emitting diodes with higher than low voltage or protection voltage ("Non-SELV" control). Alternatively, the LED support can have e.g. a base body of printed circuit board base material, e.g. FR4 (particularly inexpensive), or be a metal core board (particularly good heat dissipation).

Another embodiment is that the rest has at least one recess with a stepped edge for insertion of the LED support and the LED cover. As a result, positioning of the LED cover can be made easier. The stepped edge or the step can also in particular in the case of an LED cover in the form of a rolled sheet specifically influence its shape, e.g. impose a bend in an area of the step.

An additional embodiment is that the LED lighting device is an LED tubular retrofit lamp. An LED tubular retrofit lamp is provided to replace a tubular lamp, e.g. a fluorescent tube, a linear lamp, etc. It is here advantageous if the rest is a heat sink. The LED support and the LED cover are then preferably of elongated design. Thus the LED support can be linear, the cover cylindrical or cylinder intersection shaped and/or the rest cylinder intersection shaped, in particular semi-cylindrically shaped. However, the LED lighting device is not limited to an embodiment as a tubular lamp.

Furthermore, various embodiments provide a method for manufacturing an LED lighting device, in which the LED cover forms an intermediate layer between the rear side of the LED support and the rest or is composed of a body which also forms an intermediate layer between the rear side of the LED support and the rest. The method includes at least the following steps:

- Applying a section of the LED cover to the rest;
- Placing and fastening the LED support onto said section of the LED cover;
- Positioning the section of the LED cover, which does not rest on the rest, above the LED support so that said section overarches the LED support; and
- Fastening the positioned section such that the LED cover is rolled up.

By placing and fastening the LED support, the section of the LED cover underneath is in particular pressed onto the rest and fixed as a result.

Applying the LED cover and placing the LED support preferably takes place in such a way that on one side of the LED support a comparatively broad section of the LED cover protrudes for positioning above the LED support and on the other side of the LED support a comparatively narrow section of the LED cover protrudes for producing the joint area (or contact area).

Fastening the positioned section can be achieved e.g. by insertion of the LED cover in a mounting recess of the rest or by connecting the LED cover to the joint area.

Furthermore, various embodiments provide a method for manufacturing an LED lighting device, in which the LED cover is composed of a body which does not also form an intermediate layer between the rear side of the LED support and the rest. The method includes at least the following steps:

- Applying a heat conducting material, in particular dispersing a heat conducting adhesive, on the rest;
- Placing the rear side of the populated LED support onto the heat conducting material;
- Fastening the LED support to the heat conducting material, e.g. by leaving the heat conducting adhesive to harden;
- Arranging the LED cover, e.g. a curved film, above the LED support; and
- Fastening the LED cover.

The arrangement of the LED cover can in particular be achieved by the LED cover being inserted into a recess of the rest with a stepped edge, which also serves to receive the LED support. The edge can then serve as a lateral buffer for the LED cover in order to position this precisely.

The LED support can generally be fastened to the heat conducting material by means of the heat conducting material, e.g. if the heat conducting material also serves as an adhesive agent, or by additional means, e.g. screws or hold-down clamps, e.g. if the heat conducting material itself is not for fastening, for example, in an embodiment as a heat conducting pad ("TIM pad") or heat conducting film.

The LED cover can in particular be fastened to the rest, in particular by means of an adhesive bead.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
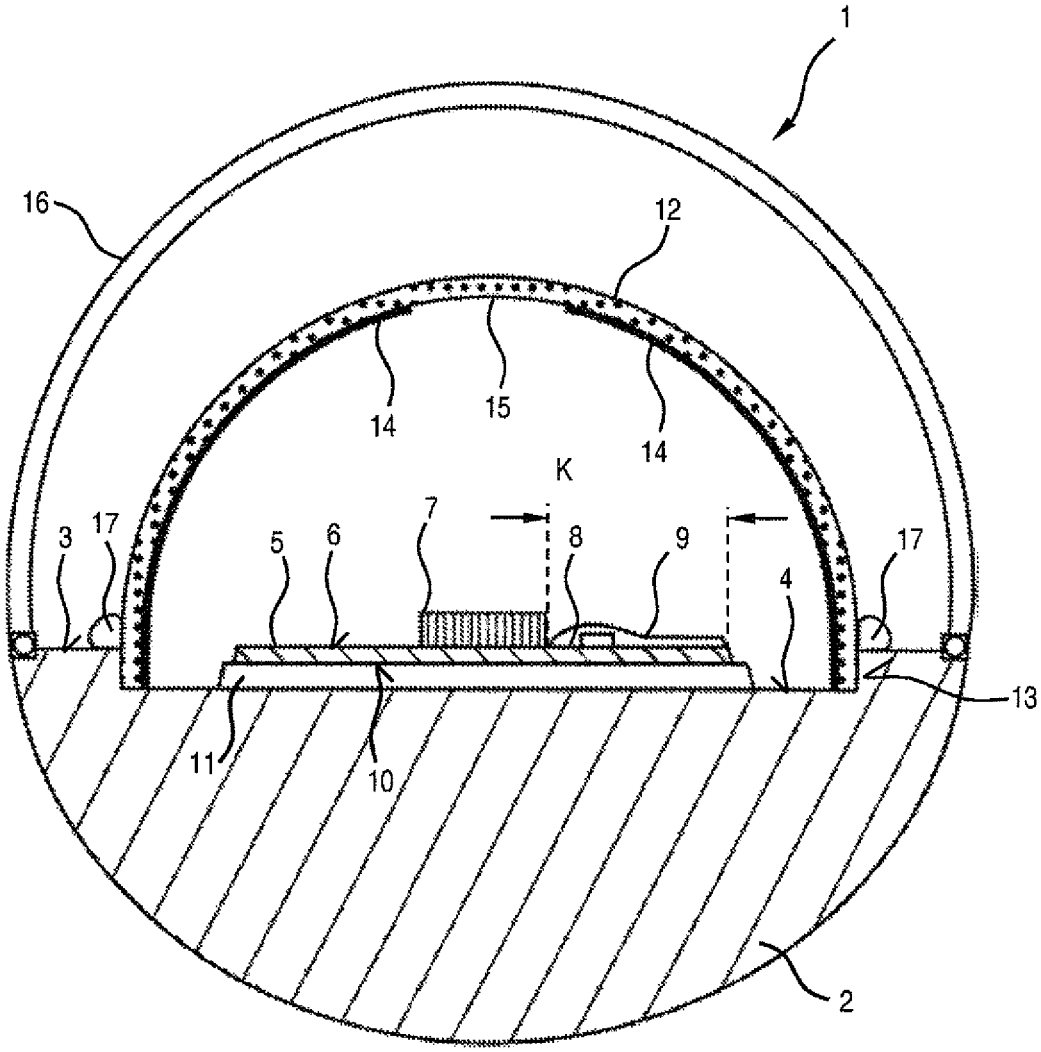
FIG. 1 shows, as a cross-section in plan view, an LED tubular lamp according to a first embodiment.

FIG. 1 shows an LED tubular lamp 1, which in particular can be used as a retrofit lamp for conventional tubular lamps such as a fluorescent tube, a linear lamp, etc. The LED tubular lamp 1 has a substantially cylindrical or tubular basic shape, the longitudinal axis of which is perpendicular to the plane of the image shown. At the ends of the LED tubular lamp 1 there may be cover caps for mechanical and/or electrical connection of the lamp to a corresponding lampholder of a luminaire (not shown).

The lower half of the LED tubular lamp 1, namely filling the cross-section in an approximately semicircular fashion, has a rest in the form of a heat sink 2. The heat sink 2 can, for example, have cooling fins. A top side 3 of the heat sink 2 facing upwards in this diagram in cross-section has a rectangular recess 4 in its center, i.e. so that the recess 4 runs in a straight line in a plane perpendicular to the image plane.

An LED support 5 which is populated or equipped with several light emitting diodes (LEDs) 7 and conductor tracks 8 on its top side or front side 6 is inserted into the recess 4. The light emitting diodes 7 are preferably arranged equidistantly in a row in a longitudinal direction of the LED tubular lamp 1. The conductor tracks 8, for example, connect the light emitting diodes 7 to each other and to an electronic control.

The conductor tracks 8 are covered by a conductor track cover 9 made of glass or a vitreous material so that a creepage distance K to the light emitting diodes 7 reaches at least to a lateral edge of the conductor track cover 9, here indicated by the distance K.

On its rear side 10 the LED support 5 rests on a bottom of the recess 4 via a layer made of a heat conducting adhesive 11. The populated LED support 5 is overarched over its whole length by an LED cover 12 which also sits in the recess 4, and namely in such a way that it presses laterally against a stepped edge 13 of the recess 4, so that the stepped edge 13 represents a lateral stop for the LED cover 12 at the same time.

The LED cover 12 here consists of an electrically insulating, light-permeable and diffusely scattering material so that the LED cover 12 serves as electrical insulation and an optical diffuser at the same time. The inside facing the LED support 5 can be partially covered by means of an opaque aperture film 14, e.g. a metallization, so that light from the light emitting diodes only passes through a window 15 left by the aperture film 14.

The LED cover 12 can consist of plastic, here for example realized in the shape of a semicircular cylindrical plastic body, wherein the LED cover 12 here is preferably self-supporting and only slightly elastically flexible. As a result of the elastic flexibility of the LED cover 12 this can, for example, be laterally compressed on both sides and then inserted into the recess 4, wherein after cessation of the application of force on both sides, the LED cover 12 springs back again laterally and can thus be held by a pressfit in the recess 4. In order to enable an even more secure connection between the LED cover 12 and the heat sink 2, for example, in order to prevent the LED cover 12 from being released during transport, etc., an adhesive bead 17 is applied to an edge between the surface 3 and the LED cover 12, e.g. by dispensing an initially liquid adhesive which then hardens.

The top 3 of the heat sink 2 as a whole is overarched by a (transparent or diffusely scattering) protection cover 16. The protection cover 16 has a substantially semicircular cylindrical cross-sectional shape and an outer contour is flush-mounted with the heat sink 2. The outer contour of the heat sink 2 and the outer contour of the protection cover 16 together form at least substantially a cylindrical surface. The protection cover 16 can, for example, be bonded to the heat sink 2 and, for example, be inserted into longitudinal grooves on the sides (not shown) of the heat sink 2 which serve as a mounting recess. The protection cover 16 likewise consists of an electrically insulating material and results in the LED support 5 with the light emitting diodes 7 and conductor tracks 8 on its top together with the LED cover 12 being doubly protected. In particular, electrically critical air gaps can be avoided in this way.

The LED tubular lamp 1 can among other things be produced by the heat conducting adhesive 11 first being dispensed in the recess 4. Then the rear side 10 of the populated LED support 5 is pressed down on the heat conducting adhesive 11 and there is a wait until the heat conducting adhesive 11 has hardened so that the LED support 5 adheres securely to the heat sink 2. In a subsequent step the LED cover 12 is inserted into the recess 4 and then bonded to the heat sink 2 by means of the adhesive bead 17. Then the protection cover 16 can be placed onto the heat sink and fastened there. In a further step the still open ends of the resulting LED tubular lamp 1 can be provided with corresponding caps for mechanical and/or electrical bonding.

When operating the LED tubular lamp 1, the LEDs 7 radiate light through the window 15, wherein an approximately point-shaped distribution of light is homogenized at the location of the LEDs 7 by the diffusely scattering property of the LED cover 12. The light beam emerging through the window 15 continues through the protection cover 16, wherein the protection cover 16 then, if it also has a beam-forming property, for example through integrated lenses, can again form, for example, focus or expand, the light beam passing through them.

The waste heat generated by the LEDs 7 is transferred by the LED support 5 and the heat conducting adhesive 11 to the heat sink 2. As the heat conducting adhesive 11 has little thermal resistance and in addition can be applied very thinly, the heat from the LED support 5 can substantially be transferred to the heat sink 2 unhindered.

The LED support 5 preferably has a base material of ceramic here (aluminum oxide, aluminum nitride, etc.) so that it firstly has very good electrical insulation, high dielectric strength, high heat resistance, which is particularly advantageous in particular when applying the conductor track cover 9 of glass, and has in addition very good thermal conductivity so that the light emitting diodes 7 can be cooled very effectively.

Figure 2:
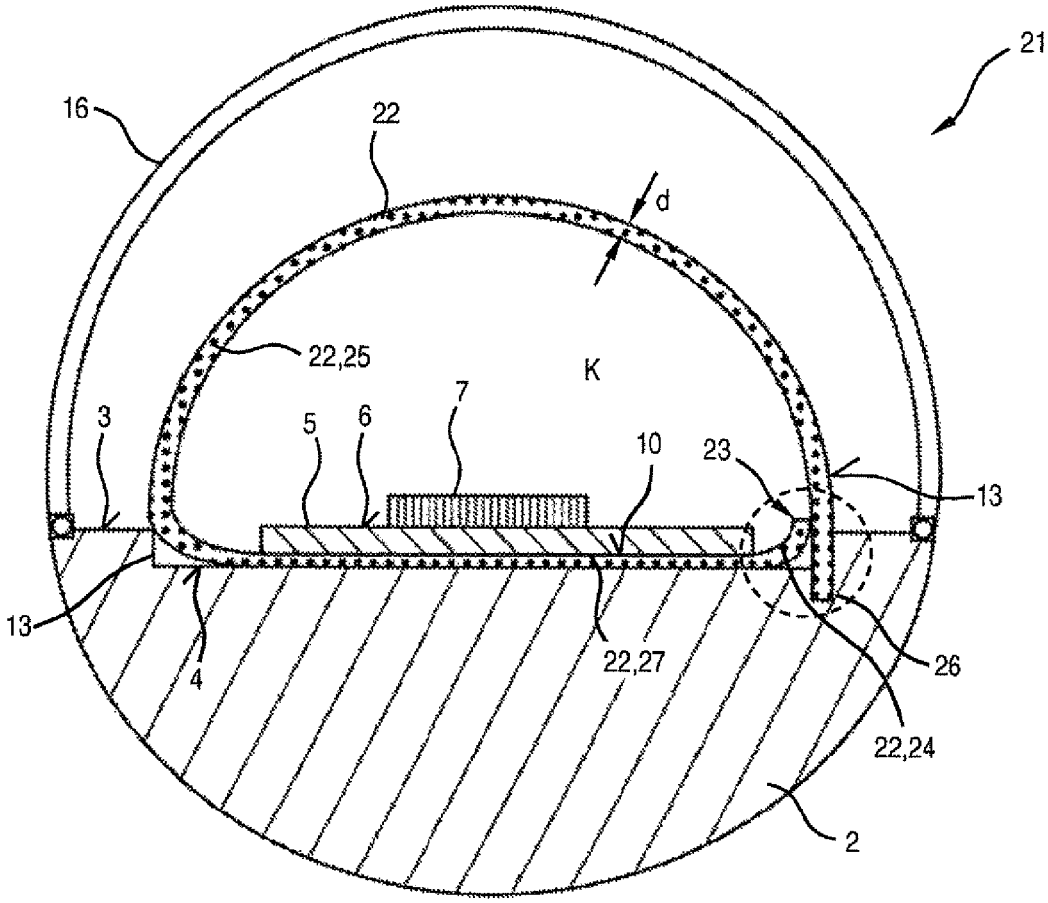
FIG. 2 shows, as a cross-section in frontal view, an LED tubular lamp according to a second embodiment.

FIG. 2 shows an LED tubular lamp 21 according to a second embodiment. In contrast to LED tubular lamp 1, the LED cover 22 is now designed in such a way that it serves as the intermediate layer 27 at the same time. To this end the LED cover 22 consists of an originally rectangular sheet (a body the thickness of which is considerably less than its level extension) made of an electrically insulating, light-permeable and diffusely scattering material, in particular plastic. The LED cover 22 is then transferred in a rolled-up state, which is shown here, in which a contact or joint area 23 is formed by the LED cover 22, where two areas of the LED cover 22 abut. The rolled-up state can be obtained not only by means of rolling movement but also by any other bending of the sheet, for example by means of extensive bending along one or more bending lines.

In the LED tubular lamp 21 the LED cover 22 has been assembled in such a way that first the sheet forming the LED cover 22 is placed on the heat sink, so that it covers the recess 4. Then the rear side 10 of the LED support 5 is inserted into the recess 4 and pressed onto the part of the LED cover 22 (which is intended to serve as the intermediate layer 27) located in the rest 2, e.g. by means of hold-down clamps or other fastening elements. As the LED support 5 is narrower than the recess 4, a narrow section 24 of the LED cover 22 remains free on one side and on the other side a wide section 25 of the LED cover 22 remains free. As a result of the stepped edge 13 of the recess 4, the narrow section 24 and the wide section 25 are bent upward there. The narrow section 24 therefore has a free lateral edge pointing obliquely upward, preferably projecting from the recess 4.

Next the wide section 25 is simply bent over the populated LED support 5 and with its free edge overlapping the free edge of the narrow section 24 inserted into a mounting recess 26 shaped as a longitudinal groove in the surface 3 of the heat sink 2. At least the free edge of the narrow section 24 presses against the wide section 25 in the process and thus forms an electrically insulating body surrounding the LED support 5 in a longitudinal direction of the LED tubular lamp 21. The end surfaces continue to be open until then, but can be suitably closed, for example, by pulling them together or pressing them together so that the LED cover 22 for the LED support 5 is substantially closed on all sides (except, for example, for bushings negligible in terms of size for mounting elements or electric cables). In the case of the LED tubular lamp 21 the joint area is only maintained by the mechanical pressure of the narrow section 24 onto the wide section 25, and no subsequent modification at the joint area 23 is necessary.

The mounting recess 26 and/or the free lateral edge of the wide section 25 can be provided with an adhesive agent before insertion of the free edge into the mounting recess 26 in order to ensure the prevention of the unintentional release of the LED cover 22, 25 from the mounting recess 26.

Depending on which mechanical properties the LED cover 22 has, in particular whether it is substantially purely elastically deformable or also practically plastically deformable, the wide section 25 of the LED cover 22 can simply be guided over the populated LED support 5 (in particular in the case of an substantially elastically deforming sheet, which is preferably also self-supporting), or the wide section 25 can be plastically bent in sections along defined bending lines (in particular in the case of a plastically bending sheet). These mechanical properties of the LED cover 22 can be set, for example, by selecting a material, in particular plastic, with appropriate mechanical bulk properties and/or by selecting a layer thickness d. A smaller layer thickness d can be advantageous to reduce thermal contact resistance between the rear side 10 of the LED support 5 and the heat sink 2. Advantageously the thickness d of the LED cover 22 is only reduced in the area which is arranged under the LED support, opposite the area covering the LEDs. This ensures mechanically stable overlay of the LEDs as well as good heat removal. For more effective heat removal, it is generally preferred that the material of the LED cover 22 has good thermal conductivity.

The LED cover 22 can also at least in its wide section 25 be equipped with an aperture layer, in particular metallization, (see figure above).

Figure 3:
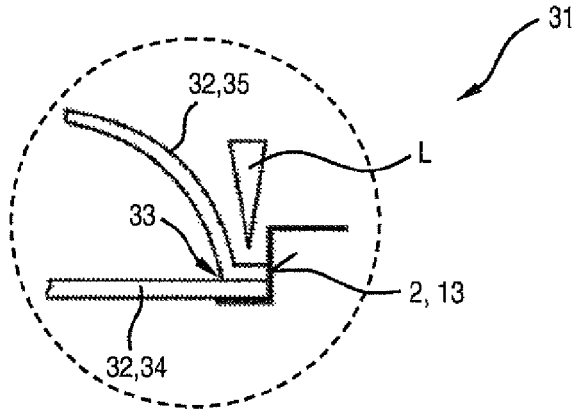
FIG. 3 shows, as a cross-section in frontal view, a segment of an LED tubular lamp according to a third embodiment

FIG. 3 shows a section of an LED tubular lamp 31 according to a third embodiment in a diagram analogous to FIG. 2, wherein the position of the section is analogous to the circle with broken lines in FIG. 2. The section shows in particular a joint area 33 of an LED cover 32.

The LED tubular lamp 31 has an at least similar structure to the tubular lamp 21, except that the narrow section 34 and the wide section 35 in the joint area 33 are firmly connected to each other. As a result the mounting recess 26 is unnecessary. The firm connection can, for example, be made using a plastic laser welding method. To this end the narrow section 34 is so narrow that it is completely located on the bottom of the recess 4 of the heat sink 2, preferably so that the free edge thereof abuts the stepped edge 13 of the recess 4, so that a precise positioning of the free edge and thus of the LED cover 32 can be achieved particularly easily. As a result the narrow section 34 lies flat on the bottom of the recess 4 so that the free lateral edge of the wide section 35 can also simply be positioned in the recess 4 above the narrow section 24, wherein the stepped edge 13 serves as a lateral stop. By gently pressing down the wide section an at least linear, preferably wide joint area or contact area is formed, which is simply achievable by means of a laser beam L to weld the two sections 34, 35. This method is also particularly easy to perform and also has the advantage that the welding method forms an electrically tight connection using standard technology.

Of course, the present invention is not restricted to the exemplary embodiments shown.

Therefore, the LED lighting device is not restricted to use with LED tubular lamps. Rather it is the case that differently designed LED lamps can also use or be constructed with the described invention. In addition, the invention is not limited to use with one lamp but can, for example, also include LED modules and LED luminaires. For example, instead of the dedicated heat sink of an LED tubular lamp shown, the heat sink can also mean a part of an LED luminaire; this can in particular mean that the LEDs 7 cannot simply be replaced as standard, which however in view of the long service life of the LEDs 7 may not be a major problem. For example, the luminaire may be a table lamp, a wall lamp or a desk lamp which can likewise have a cylindrical basic shape.

Generally speaking, the invention is not limited to elongated, e.g. cylindrical, lighting devices, but can also take any other shape, e.g. with rotationally symmetrical covers, as long as only the double cover can be implemented with the LED cover and the protection cover above the LEDs.

The material of the LED cover can contain e.g. PC, ABS and/or PMMA.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE CHARACTERS

1 LED tubular lamp
2 Heat sink
3 Top of the heat sink
4 Recess
5 LED support
6 Front side of the LED support
7 LED
8 Conductor track
9 Conductor track cover
10 Rear side of the LED support
11 Heat conducting adhesive
12 LED cover
13 Stepped edge of the recess
14 Aperture film
15 Window
16 Protection cover
17 Adhesive bead
21 LED tubular lamp
22 LED cover
23 Joint area
24 Narrow section of the LED cover
25 Wide section of the LED cover
26 Mounting recess
27 Intermediate layer
31 LED tubular lamp
32 LED cover
33 Joint area
34 Narrow section of the LED cover
35 Wide section of the LED cover
d Layer thickness
K Creepage distance
L Laser beam

The invention claimed is:

1. An LED lighting device, comprising; an LED support, which is populated with at least one LED on a front side thereof and a rear side of which is fastened to a rest, wherein the front side of the LED support is overarched by an electrically insulating, light-permeable and diffusely scattering LED cover, and wherein the LED cover is overarched by a protection cover resting on the rest.

2. The LED lighting device as claimed in claim 1, wherein the LED cover also forms an intermediate layer between the rear side of the LED support and the rest.

3. The LED lighting device as claimed in claim 1, wherein the LED cover is in the form of a rolled-up flexible sheet.

4. The LED lighting device as claimed in claim 3, wherein the rolled-up LED cover is firmly connected at its joint area.

5. The LED lighting device as claimed in claim 1, wherein the rest comprises at least one mounting recess for receiving a part of the LED cover.

6. The LED lighting device as claimed in claim 1, wherein the LED cover comprises a non-closed contour or shape and is fastened to the rest with at least some of its free edges.

7. The LED lighting device as claimed in claim 1, wherein conductor tracks present on at least the front side of the LED support are directly covered by means of a conductor track cover.

8. The LED lighting device as claimed in claim 7, wherein the conductor track cover consists of glass.

9. The LED lighting device as claimed in claim 7, wherein the conductor track cover substantially covers the entire front side of the LED support outside the LEDs.

10. The LED lighting device as claimed in claim 1, further comprising a thermally conductive heat conducting material between the rear side of the LED support and the rest.

11. The LED lighting device as claimed in claim 7, wherein the LED support comprises a base body made of an electrically insulating ceramic.

12. The LED lighting device as claimed in claim 1, wherein the rest comprises at least one recess with a stepped edge for the insertion of the LED support and the LED cover.

13. The LED lighting device as claimed in claim 1, wherein the LED lighting device is an LED tubular retrofit lamp and the rest is a heat sink.

14. A method for manufacturing an LED lighting device, the lighting device comprising: an LED support, which is populated with at least one LED on a front side thereof and a rear side of which is fastened to a rest, wherein the front side of the LED support is overarched by an electrically insulating, light-permeable and diffusely scattering LED cover, wherein the LED cover is overarched by a protection cover resting on the support, and wherein the LED cover also forms an intermediate layer between the rear side of the LED support and the rest, wherein the method comprises at least the following steps: applying a section of the LED cover on the rest; placing and fastening the LED support onto said section of the LED cover; positioning a section of the LED cover, which does not rest on the rest, above the LED support so that said section overarches the LED support; and fastening the positioned section such that the LED cover is rolled up.

15. A method for manufacturing an LED lighting device, the LED lighting device comprising: an LED support, which is populated with at least one LED on a front side thereof and a rear side of which is fastened to a rest, wherein the front side of the LED support is overarched by an electrically insulating, light-permeable and diffusely scattering LED cover, and wherein the LED cover is overarched by a protection cover resting on the support; and a thermally conductive heat conducting material between the rear side of the LED support and the rest, wherein the method comprises at least the following steps: applying a heat conducting material to the rest; placing the rear side of the populated LED support onto the heat conducting material; fastening the LED support to the heat conducting material; arranging the LED cover above the LED support; and fastening the LED cover.

16. The LED lighting device as claimed in claim 4, wherein the rolled-up LED cover is welded at its joint area.

17. The LED lighting device as claimed in claim 10, wherein the thermally conductive heat conducting material is a heat conducting adhesive.

18. The method as claimed in claim 15, wherein the heat conducting material is a heat conducting adhesive.

19. The method as claimed in claim 15, wherein fastening the LED cover comprises fastening the LED cover to the rest.

20. The method as claimed in claim 15, wherein fastening the LED cover comprises fastening the LED cover by means of an adhesive bead.

* * * * *